United States Patent [19]

Arthur et al.

[11] 4,023,003

[45] May 10, 1977

[54] POSITION INDICATING BUTTON FOR PUSH-PUSH SWITCH

[75] Inventors: Ronald H. Arthur, Fort Lauderdale; Richard J. Dykinga, Miami, both of Fla.

[73] Assignee: AMF Incorporated, White Plains, N.Y.

[22] Filed: May 28, 1975

[21] Appl. No.: 581,522

[52] U.S. Cl. ..... 200/308; 116/124 L

[51] Int. Cl.[2] ..... H01H 9/16

[58] Field of Search ..... 200/308, 317; 116/124 L, 124 R; 340/378 R

[56] References Cited

UNITED STATES PATENTS 3,644,694 2/1972 Morin et al. ..... 200/308

OTHER PUBLICATIONS

B469,228, Feb. 1976, Roy, 200/38.

*Primary Examiner*—Robert K. Schaefer
*Assistant Examiner*—Morris Ginsburg
*Attorney, Agent, or Firm*—George W. Price; John H. Gallagher

[57] ABSTRACT

A cylindrical button to be fitted on the end of the push rod of a push-push switch. Outer end of button has lens for viewing indicator having thereon two indicia representing respective switching positions of switch. Indicator is pivotally held on support means and is spring biased to indicate one switching position. Plunger extends from interior of cylindrical button through end of cylinder and is engagable with pivotally supported indicator. When switch push rod is activated to change switch to second switching position, plunger contacts switch housing and is moved further into the cylindrical button to pivot the indicator and expose second indicia through lens.

14 Claims, 7 Drawing Figures

FIG. 1
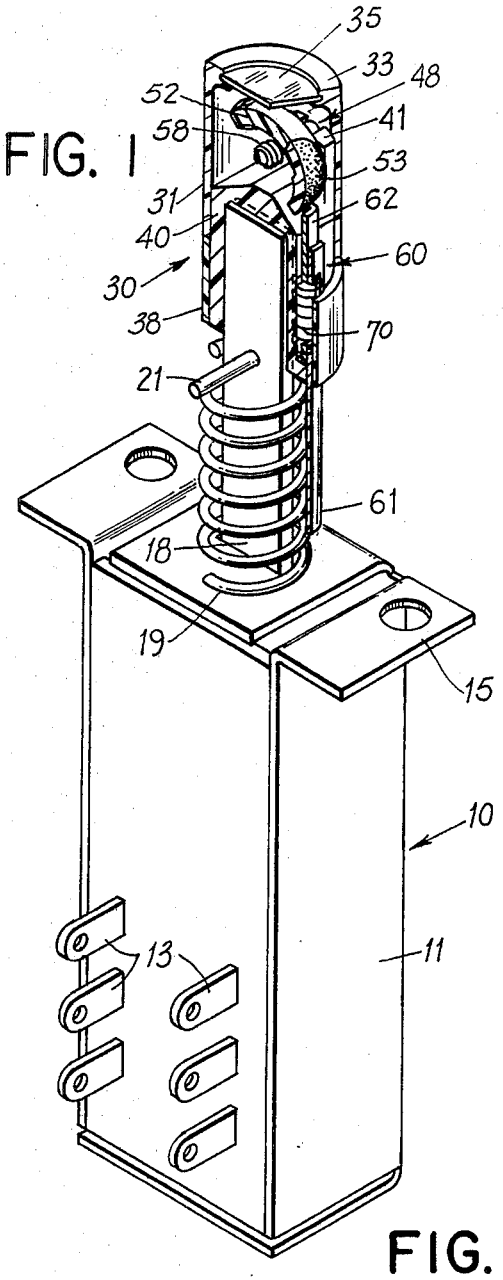
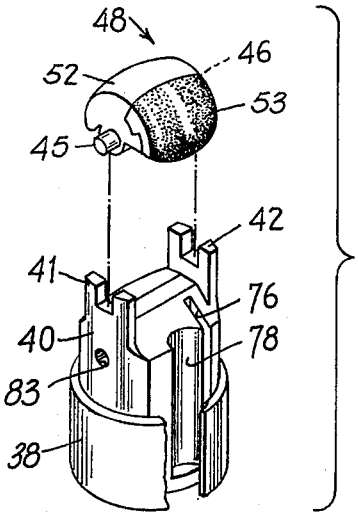
FIG. 2
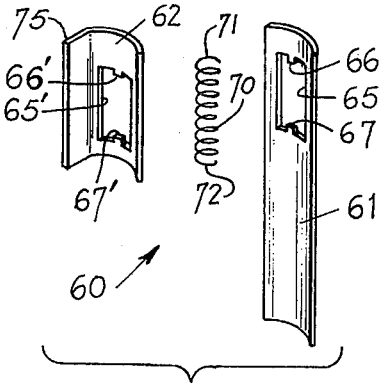
FIG. 4
FIG. 5
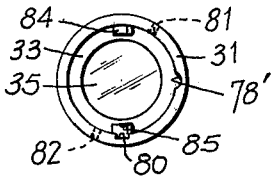
FIG. 3A
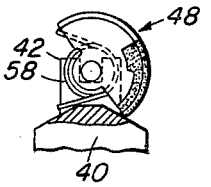
FIG. 3
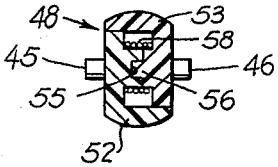
FIG. 6
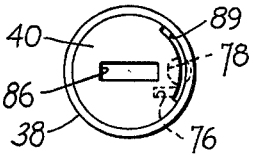

POSITION INDICATING BUTTON FOR PUSH-PUSH SWITCH

BACKGROUND OF THE INVENTION

The present invention concerns an indicator button for indicating the switching position of a push-push or push button, type of electrical switch. A variety of different types of push-push switches are known and widely used in commerce. A common feature of these switches is that the movable contacts of the switch are coupled to a push rod which extends outside of the switch housing. The push rod is movable along its axis and when pushed inwardly is retained at its inner position by some known type of retaining or latch mechanism. In response to second inward pushing force, the push rod is released from its innermost position and is returned to its outermost position by appropriate spring means. At the innermost and outermost positions of the push rod, respective different combinations of switch contacts are made and/or broken, as the case may be.

It is desirable that the operator of electrical equipment and the user of an electrical appliance be able to tell at a glance which position the switch is in. A number of indicator or flag mechanisms have been devised to provide the desired visual indication of switch position. In most of the known types of push button position indicators, the indicator is built as an integral part of the switch, thus requiring special tooling and special assembly effort for the switch itself as well as for the indicator button. Additionally, very often a particular design of an indicator button is compatible only with a particular type of switch. This further increases the expense and effort incident to providing indicator means for different types of push-push switches.

According to the present invention, an indicator button for push-push switches is provided which is rather small and compact, is relatively simple and economical to construct, provides a readily discernable visual indication, and is reliable in operation. Furthermore, the same mechanism is adaptable for use on a wide variety of types of push-push switches, and is readily adapted for use on push rods of different shapes.

BRIEF DESCRIPTION OF THE DRAWINGS

The invention will be described by referring to the accompanying drawings wherein:

FIG. 1 is a perspective view, partially broken away, illustrating the position indicator button of the present invention mounted on a push-push switch;

FIG. 2 is a perspective view of the position indicator element and the core member upon which it is mounted within the button;

FIG. 3 is a bottom view of the indicator element;

FIG. 3A is a side elevation view, partially in section, showing the indicator element and its biasing spring positioned on the core member;

FIG. 4 is an exploded view of the plunger for rotating the indicator element;

FIG. 5 is a bottom view of the top housing member of the button; and

FIG. 6 is a bottom view of the assembled bottom housing member and core member of the button.

DESCRIPTION OF PREFERRED EMBODIMENT

In FIG. 1, a push-push type switch 10 includes a housing 11 having a plurality of connector terminals 13 extending therefrom. A mounting bracket 15, which shall be considered to be part of the housing, is located at one end of the switch. A push rod 18 extends into the interior of housing 11 and has movable contacts thereon which are adapted to selectively make and break connections with stationary contacts within housing 11. A helical spring 19 is disposed about push rod 18 and is retained in compression between mounting bracket 15 and a retaining pin 21 which is secured to push rod 18.

Switch 10 includes within housing 11 a push-push type of retaining and releasing mechanism. This mechanism cooperates with push rod 18 to hold it at an innermost position within housing 11 the first time the push rod is pushed inwardly and releases the push rod and allows it to return to its outermost position, under urging of spring 19, the second time an inward pushing action is applied to the push rod. Mechanisms of this type are quite common and may be comprised of a heart-shaped cam and appropriate follower, or a star-shaped cam and appropriate latching mechanism. Since the switch itself and its operating mechanism are not the subject of this invention, they will not be further described except to mention that one type of such switch is the series 5 and 7 push button switches available from U.I.D. Electronics Division of Potter and Brumfield Division of AMF Incorporated, Hollywood, Florida.

The position indicator button 30 of this invention is attached as by a press fit to the outermost end of push rod 18 and is seated against retaining pin 21. Indicator button 30 includes a cylindrical-shaped top housing member 31 whose outermost end is closed by an end cap 33. Top housing member 31 and end cap 33 preferably are made from a light opaque plastic material. A translucent plastic viewing lens or window 35 is disposed in the center region of end cap 33 to permit a viewer to see through to the interior of top housing member 31.

In its assembled position the bottom edge of top housing member 31 is in butting contact with a cylindrical bottom housing member 38 which also may be made of a light opaque plastic material. Bottom housing member 38 is secured by glue or cement to a solid plastic internal core member 40 which extends upwardly into top housing member 31.

As seen most clearly in FIG. 2, the top portion of core member 40 includes two spaced pivot supports 41 and 42 which are adapted to receive respective pivot pins 45 and 46 of position indicator element 48.

The top surface of indicator element 48 is formed as a sector of a sphere and includes thereon two position indicating indicia 52 and 53. Indicium 52 might be colored white, for example, and indicium 53 might be colored a contrasting color such as black or red. Of course, the legends ON and OFF could be used as the indicia. In practice, the two indicia are colored white and black and are identically shaped plastic parts made from the same mold and assembled to form the indicator element 48. As seen in the bottom view of FIG. 3, the two parts are secured together and properly indexed by means of an interlocking joint 55 which is on a center shaft 56. The joint is formed by press fitting together two spaced lugs on each of the indicium parts 52 and 53. The lugs on each part are spaced apart 180° and the void spaces therebetween are adapted to receive the spaced lugs of the other part.

As best seen in FIGS. 3 and 3A, a torsion spring 58 having two end legs is placed about the center shaft 56 and serves to spring bias indicator 48 to one extreme position to indicate one switching position of the switch.

Indicator element 48 is rotated about its pivot pins 45 and 46 in the following manner. Indicator button 30 includes a plunger 60 for rotating indicator element 48 on its pivot pins 45 and 46 to expose indicium 53 to viewing lens 35 when switch 10 is in its second switching position. Plunger 60 is shown in detail in FIG. 4 and is comprised of an elongated main plunger 61 and a shorter auxiliary plunger 62. Main plunger 61 has a rectangular-shaped aperture 65 near its top end. Retaining pins 66 and 67 extend from the top and bottom sides of aperture 65. Auxiliary plunger 62 also has a rectangular-shaped aperture 65′ with retaining pins 66′ and 67′ extending from the top and bottom edges thereof. Main and auxiliary plungers 61 and 62 are held together, as shown in FIG. 1, by means of a helical spring 70. The top convolution 71 of spring 70 is positioned to be disposed about the top retaining pins 66 and 66′ of the two plunger parts and the bottom convolution 72 of spring 70 is disposed about the bottom retaining pins 67 and 67′. The main body of spring 70 thus is retained in compression within apertures 65 and 65′ of the two plunger parts 61 and 62.

Plunger 60 is slidingly positioned against a contoured side of core member 40 and its bottom end extends downwardly through the bottom of bottom housing member 38. Auxiliary plunger 62 has one edge portion 75 angled in, or bent, with respect to its main body and this angled edge portion is received and slides within a guide slot 76, FIG. 2, molded in core member 40. Core member 40 also has a concave portion 78 which is adapted to provide a clearance space for helical spring 70.

It will be seen in FIG. 5, which is a view looking at the bottom of top housing member 31, that the side wall of top housing member 31 also has a concave portion 78′ which is shaped and positioned to provide clearance space for helical spring 70. Top housing member 31 has a keyway 80 in its inner wall which registers with a key (not illustrated) on core member 40 to assure proper indexing and registration of top housing member 31 and core member 40. Diametrically opposed holes 81 and 82 in top housing member are adapted to be aligned with an aperture 83 in core member 40 to receive a retaining pin therethrough to hold the two members in assembled relationship.

Also illustrated in FIG. 5, top housing member 31 has molded on its inner wall two retaining pads 84 and 85. These pads extend outwardly from the wall of member 31 and are positioned vertically over the tops of pivot pins 45 and 46 of indicator element 48 to keep the pivot pins seated in their pivot supports 41 and 42 as the indicator element 48 is rotated by plunger 60.

FIG. 6 is a bottom view of indicator button 30. A center slot 86 is shaped to receive the top end of push rod 18 in a press fit. A side slot 89 permits main plunger 61 to freely pass therethrough.

In the operation of the indicator button 30 in cooperation with switch 10, assume first that the switch 10 is in its first switching position wherein push rod 18 is in its outermost position, as illustrated in FIG. 1. It will be noted that the length of main plunger 61 is so proportioned that it is spaced above and thus out of contact with the housing 11 (and mounting plate 15) of switch 10. In this position plunger 60 exerts no force against indicator element 48. Torsion spring 58, FIG. 3, spring biases indicator element 48 so that the white indicium 52 is visible through lens 35.

To transfer switch 10 to its second switching position, the operator will push against the top end of indicator button 30 to drive push rod 18 into the switch housing 11 where it becomes latched in its innermost switching position. As indicator button 30 moves toward switch housing 11 the bottom edge of main plunger 61 will contact the housing (mounting plate 15 being considered part of the housing), or some appropriate stop means attached to the housing, and will stop as the remainder of the indicator button continues to move downwardly toward the innermost switching position. The top edge of auxiliary plunger 62 comes into contact with the bottom side of indicator element 48 and causes it to rotate about its pivot pins 45 and 46 until the black indicium 53 is under viewing lens 35 when the innermost switching position has been reached. Rotation of indicator element 48 will stop when its left edge, FIG. 1, contacts the top portion of core member 40. In practice, indicator element 48 and core member 40 are so shaped and arranged to permit approximately 90° rotation of indicator element 48. The spring connection between main plunger 61 and auxiliary plunger 62, provided by spring 70, allows for some displacement of auxiliary plunger 62 relative to main plunger 61 in the event indicator element 48 has reached the limit of its rotation before push rod 18 has reached its innermost latched position. This feature eliminates the need for exact or very close tolerances on the lengths of the plunger parts relative to the distance of travel of button 30 between the two switching positions. Of course, the length of main plunger 61 will be chosen to be the correct length to provide the correct distance of travel for plunger 60, irrespective of the total length of travel of push rod 18 between the two switching positions.

Helical spring 70 is stronger than torsion spring 58 on indicator element 48 to assure that indicator element 48 is rotated its full amount before auxiliary plunger 62 is pushed downwardly.

Upon the application of a second axially directed force to indicator button 30, the latching mechanism in housing 11 releases push rod 18 and spring 19 urges push rod 18 and indicator button 30 upwardly to return the switch to its first switching position. As indicator button 30 rises, the bottom end of main plunger 61 will rise above the top edge of switch housing 11 and torsion spring 58 on indicator element 48 will pivot the indicator element back to its initial position in which white indicium 52 is under viewing lens 35. As indicator element 48 rotates back to its initial position it pushes plunger 60 back down to its initial position.

It will be seen that the basic mechanism of indicator button 30 readily is adapted for use on a great variety of different types of push-push switches. For different shapes of push rods 18 a suitable complementary shaped slot 86, FIG. 6, is molded into the bottom of core member 40. For different switches having different distances of travel of the push rod 18 between the outermost and innermost switching positions, the only possible alteration to the mechanism is the length of main plunger 61. Plunger 60 must travel a given distance in order to rotate indicator 48 the desired amount. The length of main plunger 61 is chosen so that the given distance the plunger must move plus the spacing of the bottom edge of main plunger 61 from housing 11 is substantially equal to the total distance that push rod 18 moves between its outermost and innermost switching positions. Of course, if the distance of travel of push rod 18 is short enough, it may be that the bottom edge of main plunger 61 may remain in contact with housing 11, or some appropriate stop means thereon.

It will be appreciated that other shapes may be provided for viewing lens 35 and indicator 48 without departing from the teachings of this invention.

In its broader aspects, this invention is not limited to the specific embodiment illustrated and described. Various changes and modifications may be made without departing from the inventive principles herein disclosed.

What is claimed is:

1. Position indicator means for indicating the switching position of an electrical switch having a push rod adapted for axial motion between outermost and innermost switching positions, said indicator means comprising an indicator housing, an indicator element within said housing, said indicator element having at least first and second indicia for indicating at least first and second switching positions of said switch, viewing means in said housing for permitting the viewing of an indicium of the indicator element therethrough, means within said housing for pivotally supporting said indicator element adjacent said viewing means to permit rotation of the indicator element and selective viewing of said indicia when the indicator element is in respective first and second viewing positions, spring means within said housing for urging said indicator element to the first one of its viewing positions, means on said housing for mounting the housing on said push rod of said electrical switch, plunger means slidably received in said housing and slidable between first and second positions along a path that intersects said indicator element and that is parallel to the direction of motion of said push rod to which the indicator means is to be attached, one end of said plunger means being free and extending to the exterior of said housing and adapted to contact, at least during inward motion of the push rod, stop means on a switch to which the housing is to be attached, said plunger means adapted to slide from its first to its second position when its one end is in contact with said stop means and the push rod moves from its outermost to its innermost switching positions, the opposite end of the plunger means being constructed and arranged to contact said indicator element at a location removed from its axis of rotation for rotating the indicator element from said first to said second viewing positions when the plunger means moves from its first to its second position, thereby to selectively expose said second indicia to said viewing means, the length of said plunger means being proportioned to rotate the indicator element to its second viewing position when a push rod connected to the housing is in its innermost switching position and to permit said spring means to slide the plunger means to its first position and to return the indicator element to its first viewing position when the push rod is in its outermost switching position.

2. The position indicator means claimed in claim 1 wherein said housing is cylindrical in shape and said viewing means is in one wall of the housing, said plunger means being constructed and arranged to slide along a path that is adjacent the inner wall of said housing and removed from the cylindrical axis of the housing.

3. The combination claimed in claim 1 wherein said means for mounting the housing on said push rod comprises a slot or recess in said housing having a complementary shape to a push rod to which the housing is to be attached, whereby said position indicator means may be press fitted onto a push rod independently of the construction and assembly of the push rod and switch.

4. The combination claimed in claim 1 wherein said plunger means is comprised of an elongated main plunger having one end portion extending to the exterior of said housing and its opposite end portion within said housing, an auxiliary plunger within said housing and coupled to said main plunger, second spring means for yieldingly coupling together said main and auxiliary plungers, said auxiliary plunger extending beyond said opposite end portion of the main plunger and positioned to selectively contact and thereby rotate said indicator element.

5. The combination claimed in claim 4 wherein said second spring means coupling said main and auxiliary plungers is a compression spring that provides a stronger spring force than the spring force provided by the first named spring means that spring biases the indicator element to its first viewing position.

6. The combination claimed in claim 5 wherein said main and auxiliary plungers are blade-like members having substantially identically shaped elongated apertures therein, and wherein said main and auxiliary plungers are disposed in contact with each other with their apertures in registration with each other, said second spring means being retained in compression within said registering apertures to yieldingly couple together said main and auxiliary plungers.

7. Position indicator means for indicating the switching position of a push-push type electrical switch having a push rod adapted for axial motion between outermost and innermost switching positions, said indicator means comprising a cylindrical-shaped top housing member having one open end, viewing means in the other end of said top housing member for permitting viewing into the interior of said housing member, a cylindrical-shaped bottom housing member, a core member associated with said bottom housing member and extending into said top housing member, said two housing members and core member comprising an enclosed cylindrical housing, means at the end of said enclosed housing opposite said viewing means for attaching the enclosed housing to a push rod of a push-push electrical switch, a rotatable indicator element having first and second position indicating indicia at respective locations thereon, means on said core member for rotatably supporting said indicator element adjacent the viewing means for selective viewing of the respective indicia when the indicator element is rotated to first and second viewing positions, spring means within said housing for spring biasing said indicator element to said first viewing position, elongated plunger means, plunger guide means on said core member for slidably supporting the plunger means adjacent the inner wall of the enclosed housing, said guide means being parallel to the cylindrical axis of the housing members for permitting the plunger means to slide along a path that intersects said indicator element at a location removed from its axis of rotation, said plunger means having one end portion extending to the exterior of said bottom housing member and being constructed and arranged to intercept stop means on a push-push switch when the enclosed housing is mounted on a switch push rod and the push rod is advanced to its innermost switching position, the length of said plunger means and its location relative to said indicator element being proportioned to rotate the indicator element to its second viewing position when a push rod to which said enclosed housing is attached is in its innermost switching position and to permit said spring means to return the indicator element to its first viewing position when the push rod is in its outermost position.

8. The combination claimed in claim 7 wherein said plunger means is comprised of an elongated main plunger having one end portion extending to the exterior of said enclosed housing and its opposite end portion within said enclosed housing, an auxiliary plunger within said enclosed housing and coupled to said main plunger, second spring means for yieldingly coupling together said main and auxiliary plungers, said auxiliary plunger extending beyond said opposite end portion of the main plunger and positioned to selectively contact and thereby rotate said indicator element.

9. The combination claimed in claim 8 wherein said second spring means coupling said main and auxiliary plungers is a compression spring that provides a stronger spring force than the spring force provided by the first named spring means that spring biases the indicator element to its first viewing position.

10. The combination claimed in claim 9 wherein said main and auxiliary plungers are blade-like members having substantially identically shaped elongated apertures therein, and wherein said main and auxiliary plungers are disposed in contact with each other with their apertures in registration with each other.

said second spring means being retained in compression within said registering apertures to yieldingly couple together said main and auxiliary plungers.

11. Position indicator means for indicating the switching position of an electrical switch having a push rod adapted for axial motion between outermost and innermost switching positions, said indicator means comprising a top housing member having a hollow interior and one open end, viewing means in the other end of said top housing member for permitting viewing into the interior of said housing member, a bottom housing member, a core member associated with said bottom housing member and extending into the open end of said top housing member, said two housing members and core member comprising an enclosed housing, means at the end of said enclosed housing opposite said viewing means for attaching the enclosed housing to a push rod of a push-push electrical switch, a rotatable indicator element having first and second position indicating indicia at respective locations thereon, means on said core member for rotatably supporting said indicator element adjacent the viewing means for selective viewing of the respective indicia when the indicator element is rotated to first and second viewing positions, spring means in said housing for spring biasing said indicator element to said first viewing position, elongated plunger means, plunger guide means on said core member for slidably supporting the plunger means adjacent the inner wall of said enclosed housing, said guide means being parallel to the direction of axial motion of a push rod to which the housing members are to be attached for permitting the plunger means to slide along a path that intersects said indicator element at a location removed from its axis of rotation, said plunger means having one free end portion extending to the exterior of said enclosed housing and being constructed and arranged to intercept stop means on a push-push switch when the enclosed housing is mounted on a switch push rod and the push rod is advanced toward its innermost switching position, the length of said plunger means and its location relative to said indicator element being proportioned to rotate the indicator element to its second viewing position when a push rod to which said enclosed housing is attached is in its innermost switching position and to permit said spring means to slide said plunger means along said guide means and return the indicator element to its first viewing position when the push rod is in its outermost position.

12. The combination claimed in claim 11 wherein said plunger means is comprised of an elongated main plunger having one end portion extending to the exterior of said enclosed housing and its opposite end portion within said enclosed housing, an auxiliary plunger within said enclosed housing and coupled to said main plunger, second spring means for yieldingly coupling together said main and auxiliary plungers, said auxiliary plunger extending beyond said opposite end portion of the main plunger and positioned to selectively contact and thereby rotate said indicator element.

13. The combination claimed in claim 12 wherein said second spring means coupling said main and auxiliary plungers is a compression spring that provides a stronger spring force than the spring force provided by the first named spring means that spring biases the indicator element to its first viewing position.

14. The combination claimed in claim 13 wherein said main and auxiliary plungers are blade-like members having substantially identically shaped elongated apertures therein, and wherein said main and auxiliary plungers are disposed in contact with each other with their apertures in registration with each other, said second spring means being retained in compression within said registering apertures to yieldingly couple together said main and auxiliary plungers.

* * * * *